US008444105B2

(12) United States Patent
Silvestri

(10) Patent No.: US 8,444,105 B2
(45) Date of Patent: May 21, 2013

(54) UMBRELLA AND ANCHORING DEVICE AND METHOD FOR USING SAME

(75) Inventor: Eric Silvestri, Brighton, MI (US)

(73) Assignee: Eric Silvestri, Brighton, MI (US)

( * ) Notice: Subject to any disclaimer, the term of this patent is extended or adjusted under 35 U.S.C. 154(b) by 125 days.

(21) Appl. No.: 12/951,724

(22) Filed: Nov. 22, 2010

(65) Prior Publication Data

US 2012/0126089 A1 May 24, 2012

(51) Int. Cl.
*F16M 13/00* (2006.01)
*E04H 17/22* (2006.01)

(52) U.S. Cl.
USPC ..... 248/530; 248/545; 248/156; 52/153; 52/157

(58) Field of Classification Search
USPC .... 248/530, 544, 545, 156; 135/15.1; 52/153, 52/157, 165
See application file for complete search history.

(56) References Cited

U.S. PATENT DOCUMENTS 3,279,133 A * 10/1966 De Korte ..... 52/103
3,285,554 A * 11/1966 Voelkerding ..... 248/121
3,335,534 A * 8/1967 Hester et al. ..... 52/169.13
3,342,444 A * 9/1967 Nelson ..... 52/165
3,823,785 A * 7/1974 Toliver ..... 173/90
4,096,951 A * 6/1978 Menssen ..... 211/207
4,240,766 A * 12/1980 Smith et al. ..... 404/10
4,459,787 A 7/1984 Wilcox
4,649,678 A 3/1987 Lamson
4,803,812 A 2/1989 Alexander, Sr.
4,819,904 A 4/1989 Shpigel et al.
5,122,014 A 6/1992 Genfan
5,535,978 A 7/1996 Rodriguez et al.
6,267,127 B1 7/2001 Doreste
6,328,046 B2 12/2001 Doreste
6,908,067 B2 6/2005 Clasen
6,953,180 B1 10/2005 Ruvalcaba et al.
7,246,783 B2 7/2007 Harold et al.
7,520,485 B1 * 4/2009 Giannetto ..... 248/530
D593,315 S 6/2009 Zemel
2004/0163336 A1 * 8/2004 Hsu ..... 52/157

* cited by examiner

*Primary Examiner* — Anita M King
(74) *Attorney, Agent, or Firm* — Varnum, Riddering, Schmidt & Howlett LLP

(57) ABSTRACT

An umbrella anchoring device comprising a support dowel and a generally truncated cone shaped umbrella stop, with two opposing surfaces, an angled wall connecting the outer perimeter of the surfaces, and a hollow passage through the vertical axis thereof which is complementary to the cross section of the support dowel, wherein the umbrella anchoring device is used to support an umbrella with at least a partially hollow shaft. A method of using the anchoring device, where the support dowel is placed generally vertically in the ground, the umbrella stop is placed over the end thereof and slid so that the wider surface is at ground level and the narrower surface is below, and an umbrella is placed over the support dowel, with the end resting on the umbrella stop.

12 Claims, 4 Drawing Sheets

UMBRELLA AND ANCHORING DEVICE AND METHOD FOR USING SAME

CROSS-REFERENCE TO RELATED APPLICATIONS

Not Applicable.

STATEMENT REGARDING FEDERALLY SPONSORED RESEARCH OR DEVELOPMENT

Not Applicable.

PARTIES TO A JOINT RESEARCH AGREEMENT

Not Applicable.

REFERENCE TO A SEQUENCE LISTING

Not Applicable.

BACKGROUND OF THE INVENTION

The invention is in the field of anchoring devices for umbrellas.

BRIEF SUMMARY OF THE INVENTION

The invention comprises a device for anchoring an umbrella into the ground, and a method of using the same, wherein the anchoring device comprises a support dowel and an umbrella stop.

The support dowel is preferably cylindrical in shape. The umbrella stop is preferably in the shape of a truncated cone, with one end having a wide surface and an opposing end having a narrow surface, wherein the outer edges of the wide and narrow surfaces are joined by an angled side wall and wherein the umbrella stop has a hollow passage extending between the opposing wide and narrow surfaces.

In use, the support dowel is positioned generally vertically in a penetrable ground surface, and the hollow passage of the umbrella stop is complementarily-shaped to fit over the end of the support dowel, allowing the umbrella stop to be moved along the length of the support dowel, to a point where the wide surface of the umbrella stop is generally level with the upper surface of the penetrable ground support and the narrow surface is below the surface of the penetrable ground support when the umbrella stop is assembled with the support dowel.

An umbrella having a generally cylindrical support shaft which is hollow at least at the bottom end is anchored in the sand, securing the umbrella in the desired position, using the umbrella anchoring device described herein by placing the hollow end of the support shaft of the umbrella over the support dowel, with its bottom end resting on the wide surface of the umbrella stop.

DETAILED DESCRIPTION OF THE PREFERRED EMBODIMENTS

Figure 1:
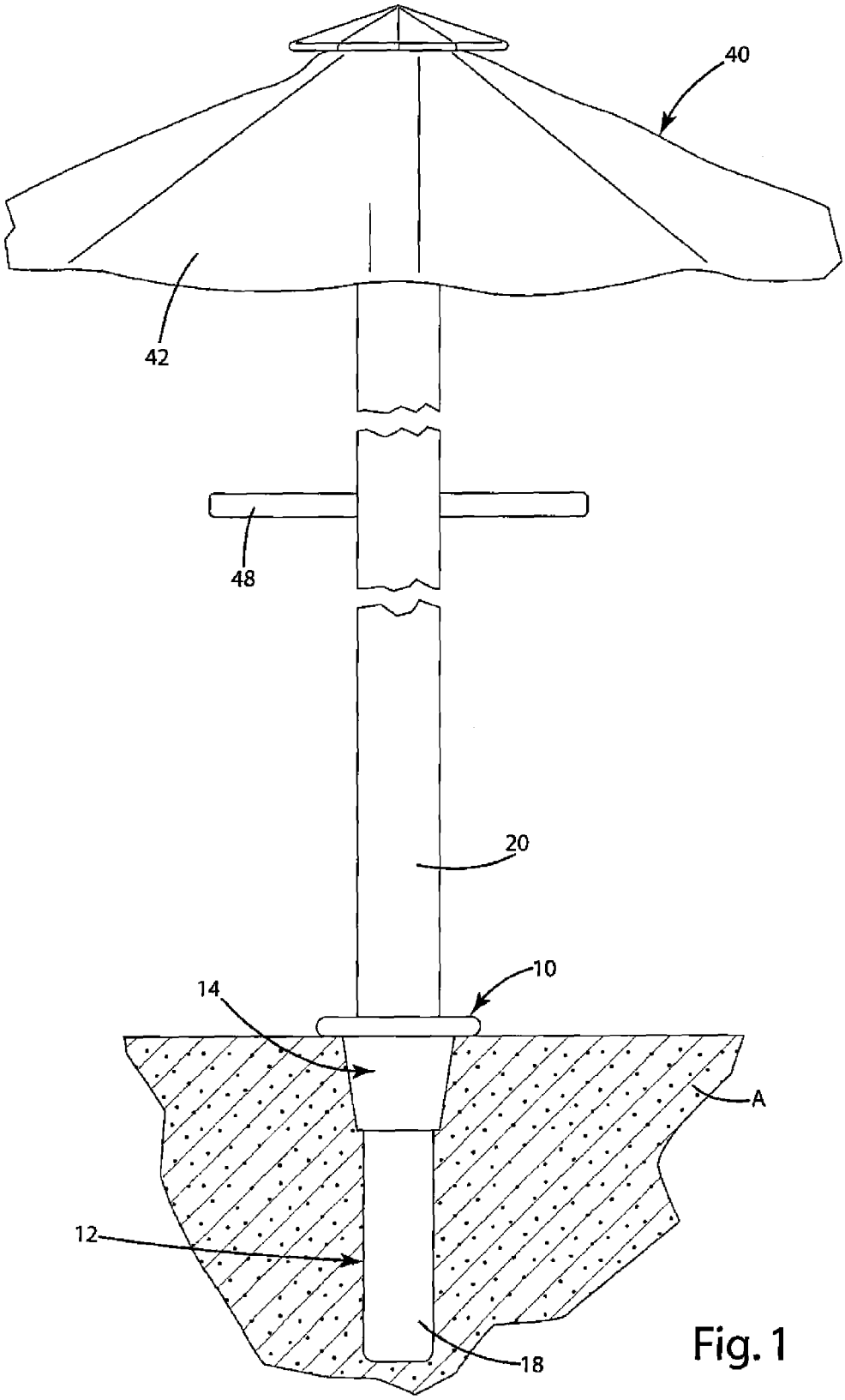
FIG. 1 is a side elevation view of the assembled umbrella, support dowel and umbrella stop.

One preferred embodiment of the umbrella anchoring device 10 as described herein comprises a support dowel 12 and an umbrella stop 14 which is releasably slidably engageable with the support dowel 12. The umbrella anchoring device 10 can be used at the beach or other locations where a portable shade is desirable to block the sun or wind from the user. Umbrella anchoring device 10 provides additional stability to hold an umbrella 40 in place.

The umbrella anchoring device 10 described herein securely but removably supports umbrella 40 in penetrable ground surface A, such that umbrella 40 is secured into the ground surface A and held at a consistent height each time anchoring device 10 is used, as determined by the length of shaft 20. Additionally, should umbrella anchoring device 10 fail, and umbrella 40 be carried away, umbrella shaft 20 does not have a pointed end which may cause more severe injury.

The anchoring device 10 described herein is also easily removable, without moving parts such as screws which may dent or deform shaft 20 or which may become covered with sand such that they are difficult to operate. Further, the components of umbrella anchoring device 10 are compact, easy to transport, and do not lengthen umbrella shaft 20 during storage or transport.

The support dowel 12 is an elongated member which is preferably cylindrical in shape, with an above-ground end 16 and a below-ground end 18. (FIGS. 1 and 2) The length of support dowel 12 is sufficient to allow dowel 12 to be anchored into a penetrable ground surface A and to extend above the surface A for a distance which allows an overlap between support dowel 12 and a hollow umbrella shaft 20. Preferably, the distance dowel 12 extends above the ground surface A is sufficient to permit a sturdy interaction between support dowel 12 and umbrella shaft 20. The above-ground end 16 and below-ground end 18 are preferably interchangeable when support dowel 12 is in use.

Figure 2:
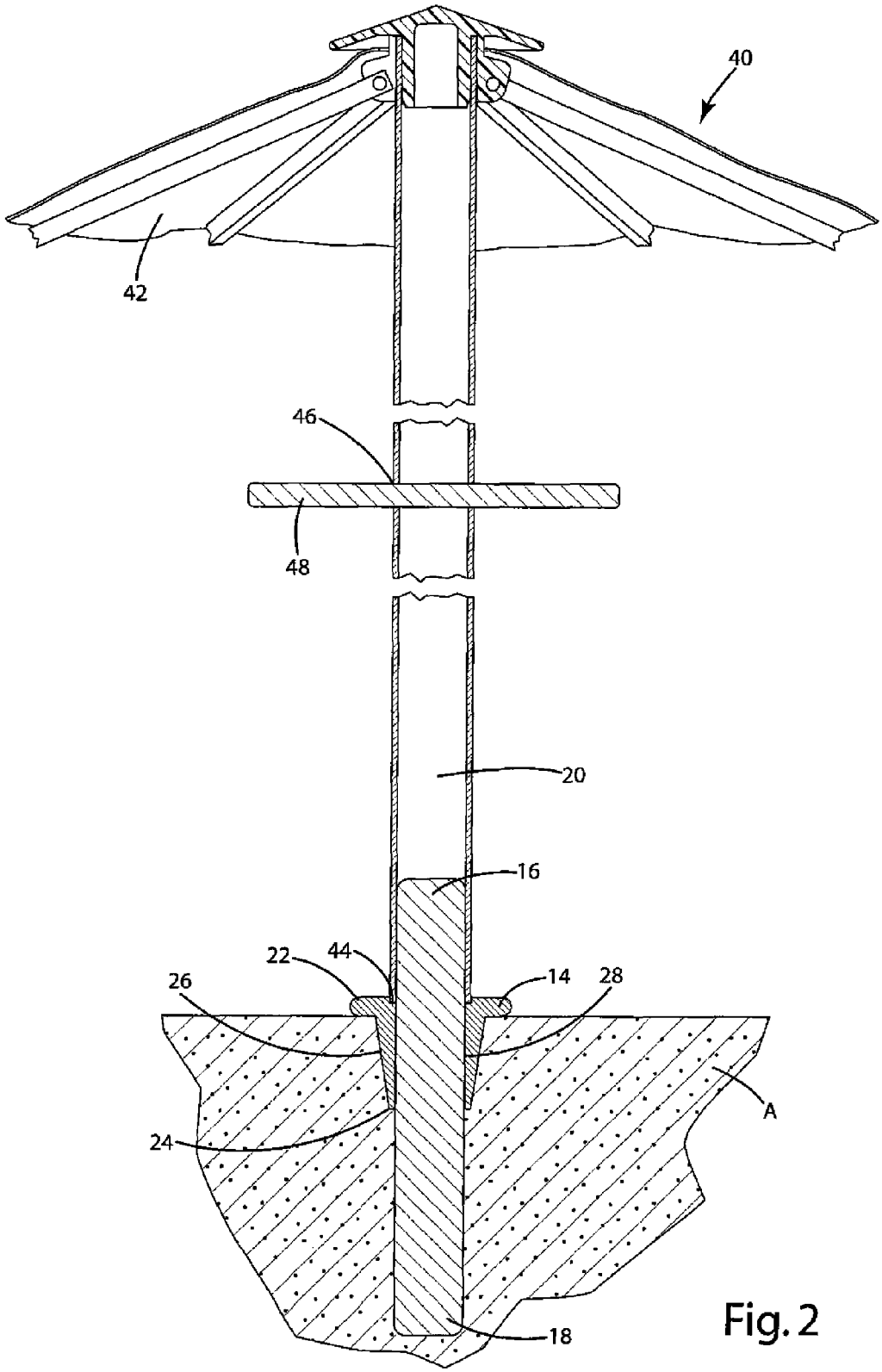
FIG. 2 is a side elevation cutaway view of the assembled umbrella, support dowel and umbrella stop.
Figure 4:
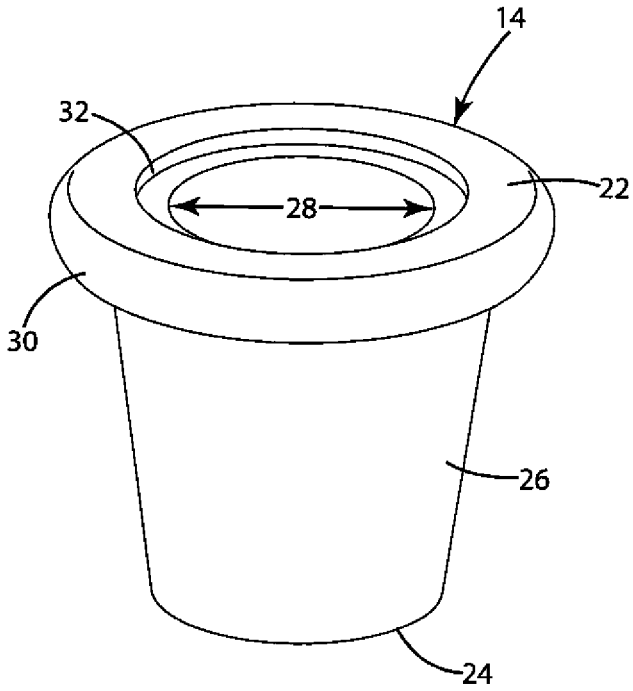
FIG. 4 is a top perspective view of the umbrella stop.

The umbrella stop 14 is preferably in the shape of an inverted, truncated cone, with surface 22 which is preferably round, opposing surface 24, which is also preferably round and of a smaller diameter than surface 22, and an angled side wall 26 joining the outer edges of surfaces 22, 24. (FIGS. 2 and 4.) A hollow passage 28 is provided between surfaces 22, 24 and through the center vertical axis of umbrella stop 14. The hollow passage 28 is preferably shaped so as to be complementary to the cross sectional area of support dowel 12. which allows umbrella stop 14 to be easily moved along the length of support dowel 12, such that umbrella stop 14 can be positioned at a height such that wide surface 22 is generally level with the upper surface of the penetrable ground surface A and the narrower surface 24 is below the surface of the penetrable ground A when the umbrella stop 14 is assembled with the support dowel 12.

Additionally, a lip 30 around the circumference of surface 22 extends outward from the center axis of umbrella stop 14, providing a wider top surface 22 for the umbrella stop 14. (FIG. 4.) A ridge 32 is also provided on surface 22, with a diameter slightly larger than the outside diameter of shaft 20, such that the portion of surface 22 between hollow passage 28 and ridge 32 is indented to receive shaft 20.

An umbrella 40 to be used with the umbrella anchoring system 10 has an umbrella shaft 20 and a canopy 42, which may or may not be provided in an assembled form. (FIGS. 1 and 2.) At least the lower portion of shaft 20 is hollow, with an opening 44 at the bottom of shaft 20, which allows shaft 20 to be placed over support dowel 12. Shaft 20 preferably has at least one hole 46 through the wall thereof, preferably near the top end of shaft 20, to allow insertion of a handle 48 or to allow canopy 42 to be removably secured to shaft 20 using a fastener. Preferably two or more holes 46 are provided in alignment to allow a straight handle 48 to be inserted through two of the holes 46.

Figure 3:
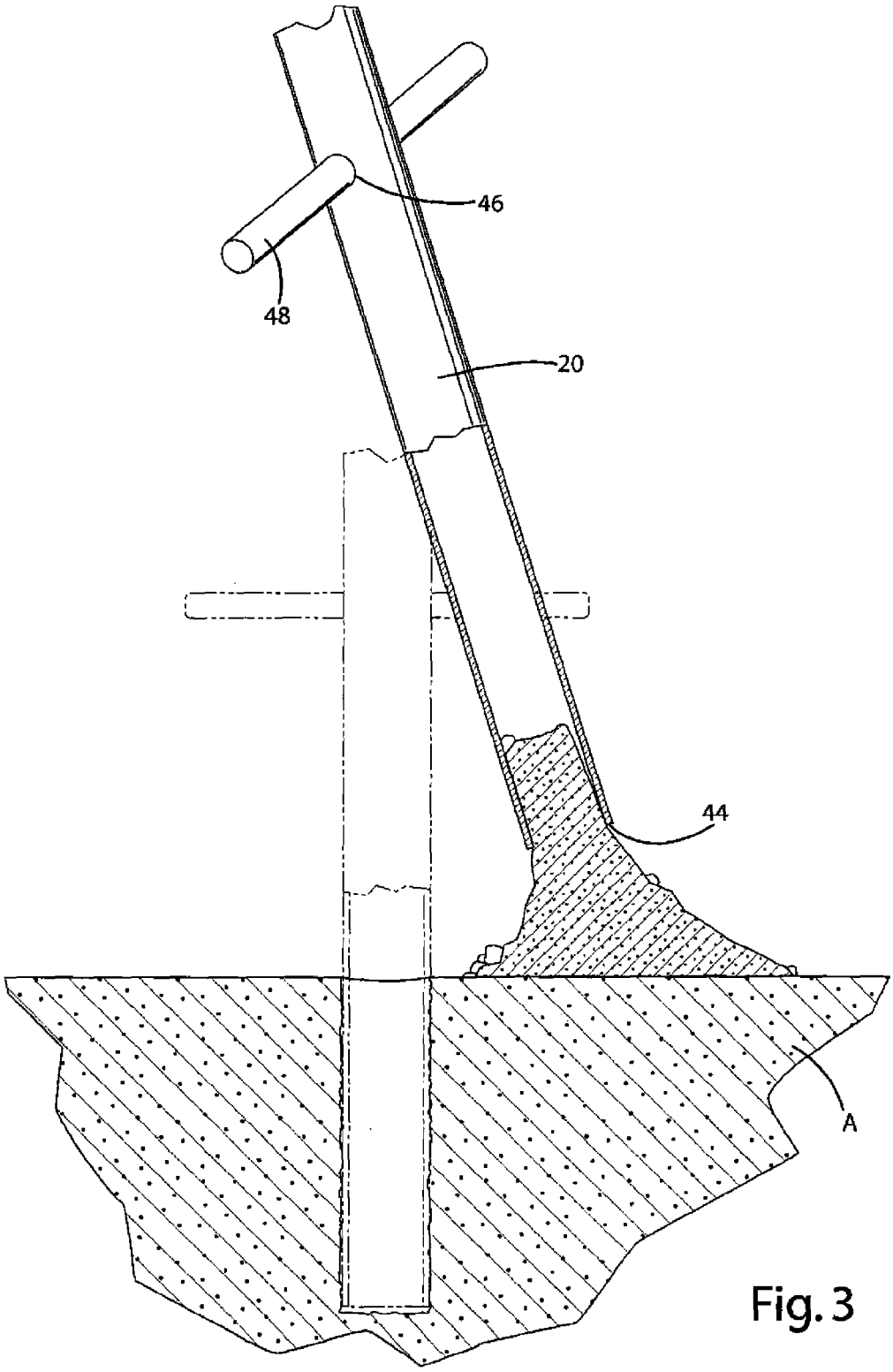
FIG. 3 is a side view of the support shaft of the umbrella with a handle, as used to remove the plug of soil.

To install the umbrella anchor 10 and umbrella 40 embodiment described herein, umbrella shaft 20 is preferably used to prepare a hole in penetrable ground surface A. (FIG. 3.) Preferably, a handle 48 is inserted through opposing holes 46 in the top portion of the shaft 20. Shaft 20 is then pushed downward into penetrable ground surface A, such that the bottom of shaft 20 is inserted semi-vertically or vertically into ground surface A, and then removed. Opening 44 and the hollow bottom of shaft 20 allow a plug of ground surface A to be cut and pulled out in the hollow bottom of shaft 20 when shaft 20 is removed, forming a hole in penetrable ground surface A. This process can be repeated to prepare a hole of the desired depth to securely anchor support dowel 12.

When the hole is prepared, support dowel 12 is placed into the hole. Umbrella stop 14 is then placed over the top of support dowel 12 so that support dowel 12 extends through hollow passage 28, with the larger diameter surface 22 facing upward and the smaller diameter surface 24 facing downward. The umbrella stop 14 is slid down support dowel 12 so that surface 22 is about adjacent to ground surface A so that the wider surface 22 and lip 30 hold umbrella stop 14 at ground surface A, with the remainder of umbrella stop 14 stabilizing the ground surrounding support dowel 12.

Umbrella shaft 20 is placed over support dowel 12, with the hollow bottom resting on surface 22, preferably within ridge 32 for added stability, and canopy 42 is attached to shaft 20.

Of course it is understood that the above is a description of preferred embodiments, and that various changes and alterations can be made to umbrella anchoring device 10 or the method of using the same without departing from the spirit and broader aspects of the invention.

What is claimed is:

1. An umbrella anchoring device comprising:

a support dowel;

an umbrella stop having a wide surface and an opposing narrow surface, joined by at least one side wall, wherein the umbrella stop has a hollow passage extending between the opposing wide surface and narrow surface, wherein the passage of the umbrella stop is complementarily shaped to the support dowel and removably slidably engageable with the support dowel;

the wide surface of the umbrella stop further has a rim which extends outward from the side wall; and the wide surface of the umbrella stop further has a recessed ring therein, sized to receive a support shaft of an umbrella.

2. The umbrella anchoring device of claim 1, wherein the umbrella stop is generally in the shape of a truncated cone.

3. The umbrella anchoring device of claim 1, wherein the support dowel has a circumference which is sized to fit within a hollow lower end of a support shaft of an umbrella.

4. A method of installing an umbrella anchoring device comprising the steps of:

placing a support dowel into a penetrable ground surface;

locating an umbrella stop along the length of the support dowel, wherein the umbrella stop has a wide surface and an opposing narrow surface, joined by a side wall, wherein the umbrella stop has a hollow passage extending between the opposing wide surface and narrow surface permitting passage of the support dowel, such that the wide surface is generally level with the top of the penetrable ground surface;

a hollow shaft is used to remove a plug of the penetrable ground surface to allow insertion of the support dowel, with the hollow shaft further comprising at least a portion of the support shaft of an umbrella to be anchored by the umbrella anchoring device; and the support shaft has at least two opposing holes provided through the top end thereof, and at least one handle insertable through the opposing holes, wherein the handle provides additional leverage to push the support shaft into the penetrable ground surface to remove the plug.

5. A method of installing an umbrella, comprising the steps of:

placing a support dowel into a penetrable ground surface;

locating an umbrella stop along the length of the support dowel, with the umbrella stop having a wide surface and an opposing narrow surface, joined by a side wall, wherein the umbrella stop has a hollow passage extending between the opposing wide surface and narrow surface permitting passage of the support dowel, such that the wide surface is generally level with the top of the penetrable ground surface; and placing an umbrella comprising a support shaft with a hollow lower section over the portion of the support dowel protruding from the ground surface, such that the lower end of the support shaft rests on the wide surface of the umbrella stop.

6. The method of installing an umbrella of claim 5, wherein the umbrella comprises a support shaft and a canopy portion.

7. The method of installing an umbrella of claim 5, wherein the wide surface of the umbrella stop has a rim which extends outward from the conical side wall.

8. The method of installing an umbrella of claim 7, wherein the wide surface of the umbrella stop has a recessed ring therein, sized to receive the support shaft of the umbrella.

9. The method of installing an umbrella of claim 8, wherein a hollow shaft is used to remove a plug of the penetrable ground surface to allow insertion of the support dowel.

10. The method of installing an umbrella of claim 9, wherein the hollow shaft comprises at least a portion of the support shaft of the umbrella.

11. The method of installing an umbrella of claim 10, wherein the support shaft has at least two coaxially aligned holes provided through the top end thereof, and at least one handle insertable through the coaxially aligned holes, wherein the handle provides additional leverage to push the support shaft into the penetrable ground surface to remove the plug.

12. The method of installing an umbrella of claim 11, wherein the at least two coaxially aligned holes are also used to engage the lower portion of a canopy portion of the umbrella.

* * * * *